United States Patent [19]

Sarazen et al.

[11] Patent Number: 4,754,696

[45] Date of Patent: Jul. 5, 1988

[54] VENTILATOR WITH ADJUSTABLE INSTALLATION MEANS

[76] Inventors: Paul M. Sarazen, 214 Fairview Dr.; Dennis A. Beam, 410 Westfield Rd., both of Shelby, N.C. 28150

[21] Appl. No.: 55,900

[22] Filed: May 28, 1987

[51] Int. Cl.[4] ..... F24F 13/15

[52] U.S. Cl. ..... 98/29; 52/573; 98/114; 236/49

[58] Field of Search ..... 52/208, 217, 573; 98/1, 98/29, 37, 114; 236/49 B

[56] References Cited

U.S. PATENT DOCUMENTS

| | | | |
|---|---|---|---|
| 4,243,175 | 1/1981 | McSwain | 98/32 X |
| 4,493,456 | 1/1985 | Sarazen, Jr. et al. | 236/49 B |
| 4,587,892 | 5/1986 | Witten | 98/29 |

FOREIGN PATENT DOCUMENTS

| | | | |
|---|---|---|---|
| 2355152 | 1/1978 | France | 52/217 |

*Primary Examiner*—Harold Joyce
*Attorney, Agent, or Firm*—Dority & Manning

[57] ABSTRACT

An automatic temperature responsive ventilator including a housing having side walls defining an air passageway and an openwork grid across the passageway. At least one shutter is mounted within the housing, with one end of one shutter element being associated with a bimetallic spring, the inner end of which is received within an opening in one housing side wall. An outer end of the spring is secured to the shutter. A size-adjustable installation device includes a threaded portion which engages a threaded opening in the housing or in a member held non-rotatable relative to the housing. One end of the threaded portion is integral with a non-threaded distal portion having a diameter less than the diameter of the threaded portion and carrying thereon the small diameter end of a conically shaped compression spring. Variations in ambient temperature cause the shutter element to open and close automatically.

17 Claims, 4 Drawing Sheets

VENTILATOR WITH ADJUSTABLE INSTALLATION MEANS

BACKGROUND OF THE INVENTION

The present invention relates to a ventilator structure of the type that is normally disposed in the foundation of a dwelling or other building structure. Particularly, the present invention relates to a ventilator having an adjustable installation device to adapt the size of the ventilator to improperly sized installation openings.

An automatic ventilator, such as shown in U.S. Pat. No. 4,210,279, which is hereby incorporated herein by reference, has one or more shutters received in a passageway and connected by some means to a thermally responsive spring, such as a bimetallic spring, whereby the shutters automatically open and close, depending upon the ambient temperature. A device for securing the ventilator into an opening is disclosed in U.S. Pat. No. 4,493,456, which is hereby incorporated herein by reference, and employs a threaded set screw and a non-rotational element. To facilitate installation of such ventilators, it is desirable to be able to provide some means of varying the installation dimensions of the ventilator. One such device employing a compression spring is disclosed in U.S. Pat. No. 4,587,892. However, this device provides a rotational axis through screw 35 and spring 36. The ventilator is likely to move about this axis upon impingement of air currents on the ventilator. The range of rotation depends upon how much space develops between the exterior wall surface and the rear surface of flange 16. This kind of movement can cause annoying noises when the flange suddenly contacts the front surface of the wall as air currents impinge upon the ventilator in a manner that causes the ventilator to rotate about the axis formed through screw 35 and spring 36. Moreover, the '892 device is not controllably adjustable, i.e., the adjustment device is not subject to the control of the person installing the ventilator into the opening.

SUMMARY OF THE INVENTION

It is an object of the present invention to provide an improved, automatic ventilator assembly suitable for mounting in the foundation of a dwelling structure or the like so as to control the ingress of air beneath the floor level of same.

Another object of the present invention is to provide an improved automatic ventilator structure that utilizes a tension-adjustable bimetallic spring for automatic opening and closing of shutter elements in the vent structure.

A further object of the present invention is to provide an improved automatic ventilator assembly that may be conveniently and securely installed in existing openings in foundation walls without the need for mortar.

Another object of the present invention is to provide an improved automatic ventilator assembly that may be conveniently and securely installed into improperly sized openings in foundation walls without the need for mortar.

Yet another object of the present invention is to provide an improved ventilator assembly where the housing for same is molded of a synthetic, polymeric material and is unitary in structure and wherein a tension-adjustable bimetallic spring operable to automatically open and close shutter elements of the ventilator is received within one of the side walls of the housing so as to be exposed to ambient temperature while being protected from the elements.

Generally speaking, the present invention relates to an automatic ventilator structure comprising a housing. The housing has peripheral side walls defining an air passageway therethrough. At least one shutter element is received in the air passageway and mounted to the housing for rotary movement between a closed position, where the passageway is generally closed, and an open position, where the passageway is generally open, to the passage of ventilating air therethrough. Temperature-responsive drive means are provided to move the shutter elements between varying degrees of the open and closed positions. A fastening means is operatively associated with one end of the drive means and the shutter element, whereby temperature variation effects on such drive means cause the shutter element to move toward an open or closed position. A setting plug is received in a setting opening defined in one of the side walls of the housing and secured against rotation therein. The plug also has means to secure the other end of the drive means thereto so that when the plug is secured against rotation, so is the drive means.

The temperature-responsive drive means preferably comprises a temperature responsive bimetallic spring. The fastening means which is operatively associated with the drive means and the shutter element preferably comprises a fastener such as a pop rivet which is connected directly to the shutter element and one end of the bimetallic spring.

More specifically, the automatic ventilator of the present invention preferably includes a molded plastic housing that is unitary in structure insofar as side walls, front collar, and grid structure are concerned. Behind the grid structure and within the side walls are mounted a plurality of shutter elements that are interconnected for simultaneous movement. The side walls define an air passageway therebetween and through which ventilating air may pass or be excluded, depending upon the attitude of the shutter elements. One of the side walls further defines a setting opening, generally cylindrical in shape. The setting opening receives a setting plug having a receiving slot in which one end of a bimetallic coil or thermally responsive spring is received. An opposite end of the spring is secured by a fastening means to one of the shutter elements whereby temperature variations significant to produce an expansion or contraction effect on the coil spring cause the rod to rotate in the appropriate direction and to drive the shutter toward an open or closed position.

The front collar may be a separate structure secured to the housing instead of integral therewith. In both embodiments, the collar generally includes side walls defining an opening therewithin that corresponds in general to the size of the passageway of the ventilator housing and further has an outwardly extending peripheral flange around the side walls. A ventilator with a front collar may be suitably employed in an opening of a foundation, or the like, with the outwardly extending peripheral flange of the collar contacting an outer surface of the structure wall and covering any space between the vent housing and the wall per se.

Means are provided for adapting the ventilator to the size of an improperly sized installation opening. The adapting means preferably includes a bolt having at one end a means for receiving an adjustment tool and an intermediate portion that is externally threaded. The means for receiving an adjustment tool can comprise a slotted portion such as a split head which receives the blade of a screwdriver. Integral with the other end of the threaded bolt is a distal portion having a uniform cross-sectional diameter that is smaller than the diameter of the threaded bolt. The adapting means further preferably includes a conically shaped compression spring having a smaller diameter end which fits securely around the distal portion and is prevented from riding up onto the threaded portion of the bolt by the ridge formed by the end of the threaded portion. The length of the spring is preferably twice the length of the distal portion. One embodiment of the adapting means includes a threaded aperture defined in only one side wall of the housing and configured for receiving the threaded portion of the bolt so that rotation of the bolt displaces same longitudinally relative to the housing.

In an alternative embodiment, the adapting means preferably includes an internally threaded member having a threaded aperture configured to engage the threaded portion of the bolt. The internally threaded member is non-rotatably secured to the housing of the ventilator so that rotation of the threaded bolt causes longitudinal displacement of the threaded bolt relative to the ventilator housing.

In another alternative embodiment, the adapting means preferably includes a spring collar which has a centrally located aperture which has a diameter approximately equal to that of the distal portion and which is smaller than the diameter of the threaded portion of the bolt. The spring collar slides over the distal portion and has a flat surface which butts against the ridge of the threaded portion. The opposite side of the spring collar has a flat surface for retaining the spring around the distal portion and preventing the spring from riding up onto the threaded portion of the bolt.

In another alternative embodiment of the present invention, the adapting means comprises two bolts spaced apart and passing through only one and the same side wall of the housing of the ventilator.

DESCRIPTION OF THE PREFERRED EMBODIMENTS

Figure 1:
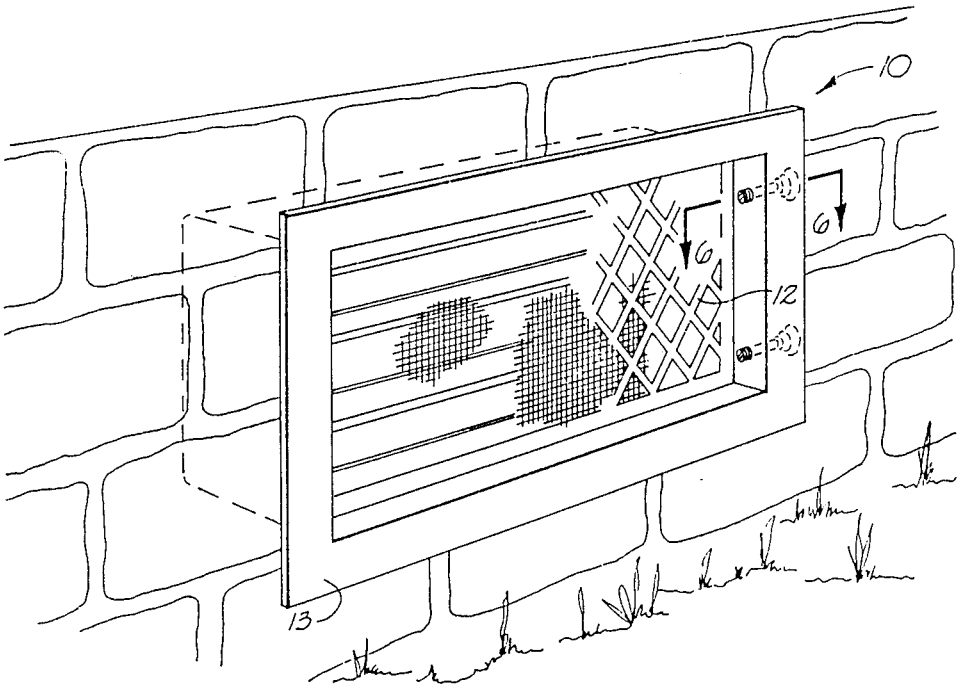
FIG. 1 is a front elevational view of a ventilator structure according to the present invention shown in its intended environment and illustrated partially in hidden line.

Referring to the figures, preferred embodiments of the present invention will now be described in detail. FIG. 1 for example, illustrates a ventilator according to teachings of the present invention in a preferred environment of use of same, that is, a foundation wall W of a dwelling structure or the like where the ventilator provides means for ingress of ventilating air beneath the floor. Under normal construction of the wall W from brick as shown, a generally rectangular shaped installation opening would be provided in the wall wherein the ventilator may be received and appropriately secured. The ventilator, generally indicated as 10, controls the amount of air flow, depending upon ambient temperature.

Figure 2:
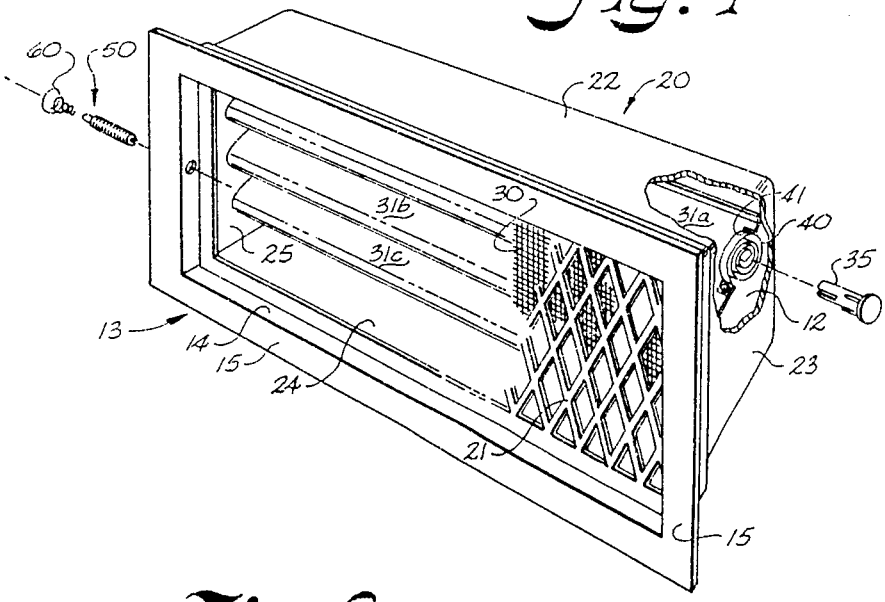
FIG. 2 is an isometric assembly view of a ventilator structure according to the present invention with part of the housing broken away.

As to the particular details of one embodiment of ventilator construction, reference is made to U.S. Pat. No. 4,715,532 issued on Dec. 29, 1987, by the present inventors, which application is hereby incorporated herein by reference. Briefly, as shown in FIG. 2, a housing is generally indicated as 20. The housing is preferably of unitary construction and comprises an openwork grid structure 21 and four side walls 22, 23, 24, and 25. Side walls 22, 23, 24, and 25 define an air passageway 12 in which a plurality of shutter elements 31*a*, 31*b* and 31*c* are received and mounted to side walls 23 and 25 by mounting elements (not shown in FIG. 2) for limited rotary movement thereat between an opened and closed position.

A collar generally indicated as 13 may also be provided. As shown in FIG. 2 for example, one embodiment of collar 13 is made up of a plurality of side walls 14 having peripheral flanges 15 secured thereto and extending outwardly therefrom. Side walls 14 are coextensive with housing side walls 22, 23, 24 and 25 and joined thereto. As shown in FIG. 2, collar 13 may be a separate structure that is secured to the housing. In a preferred embodiment of collar 13 shown in FIGS. 1, 3, 5, 6, 8 and 9 for example, collar 13 is formed integrally with side walls 22, 23, 24 and 25. In this preferred situation, the housing and collar of the ventilator of the present invention are of unitary construction, having been molded from a thermoplastic, polymeric material. In such embodiments, as shown for example in FIG. 6, side walls 14 of collar 13 can be considered extensions of side walls 22, 23, 24, and 25, and the side walls extend from both sides of openwork grid structure 21.

Collar 13 extends into the side wall W so as to secure the ventilator in place. Utilizing collar 13 in this fashion, a ventilator 10 according to the present invention may be installed without the need for mortar, and moreover will present a good appearance for various size openings in a foundation wall, where the difference between the size of the opening and the ventilator housing will be covered by the peripheral flange 15 of collar 13.

Housing 20 may further be provided with a screen 30 that is located behind grid 21 and secured in place. Screen 30 precludes the passage of insects through the air passageway of the ventilator structure.

In accordance with the present invention, there is provided temperature responsive drive means for driving the ventilator between a condition open to the passage of air therethrough and a condition closed to the passage of air therethrough, depending upon the air temperature. As embodied herein and shown for example in FIGS. 2–4, the temperature responsive drive means preferably comprises a thermally responsive coil spring 40. Preferably, coil spring 40 is a bimetallic spring.

In further accordance with the present invention, fastening means are provided for operatively connecting the drive means to the shutter elements. As embodied herein and shown for example in FIGS. 3 and 4, the fastening means for operatively connecting the drive means to the shutter elements preferably comprises a rivet 34 secured to shutter element 31*a* and the outer end of spring 40. A pop rivet performs well as the fastening means. As shown in FIGS. 2 and 4 for example, one end of shutter element 31*a* is configured to define a cutout portion 41 for receiving coil spring 40 therein.

Figure 3:
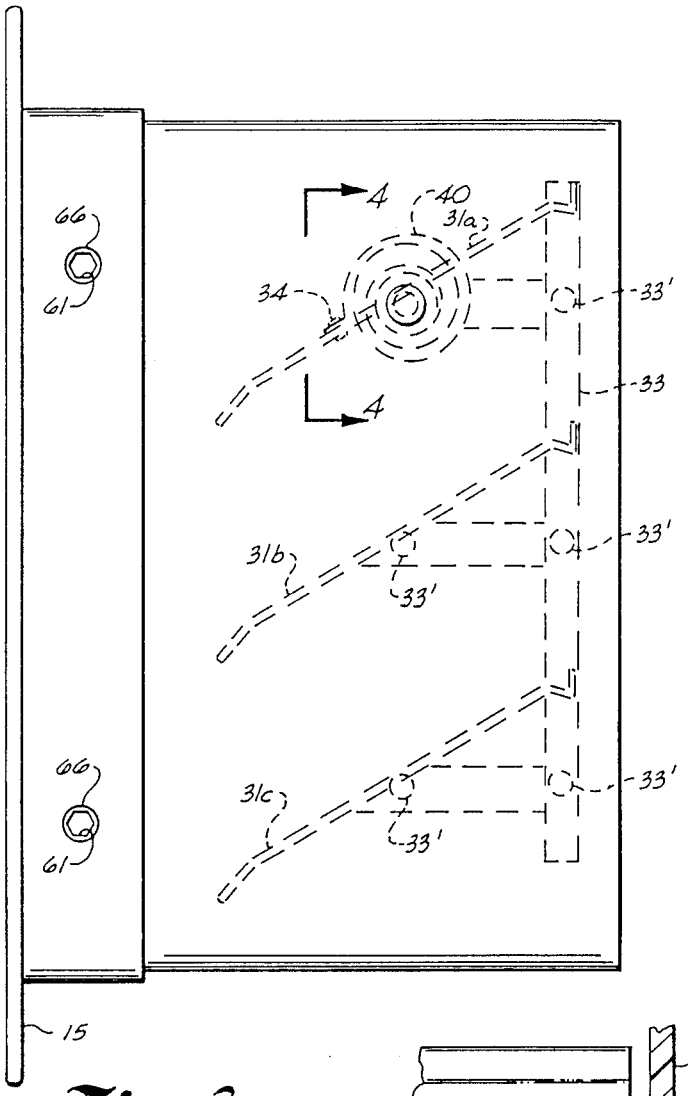
FIG. 3 is a side elevational view of a ventilator structure according to the teachings of the present invention with certain internal features indicated in hidden line.
Figure 4:
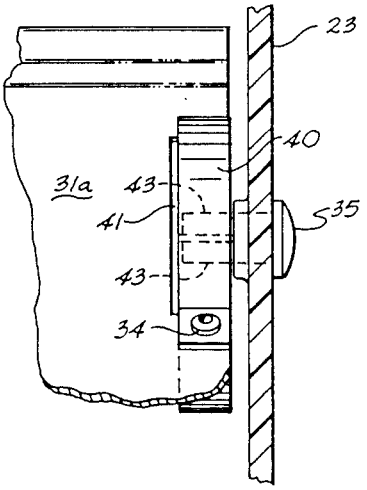
FIG. 4 is an exploded partial view of an embodiment of the present invention taken along line 4—4 of FIG. 3.

As shown in FIG. 3, shutter elements 31*a*, 31*b* and 31*c* are preferably interconnected by an elongated strip 33 that extends therebetween within housing 20 and is secured to each shutter by studs 33' for pivotal movement. In this fashion, as changing ambient temperature causes spring 40 to contract or expand, shutter element 31*a* connected thereto rotates towards a closed or an open position, depending upon the particular change in temperature. In like fashion, since connector strip 33 is secured between all of the shutter elements, all of the elements simultaneously move in the direction of an open or closed position.

In further accordance with the present invention, a setting plug 35 is received in a setting opening defined in one of the side walls of the housing and secured against rotation therein. Plug 35 has means to grasp and hold the inner end of bimetallic spring 40 against rotation. As shown in hidden line in FIG. 4 for example, the grasping means comprises two opposed gripping members 43. Details of the setting plug are disclosed in U.S. Ser. No. 06/886,531, filed on July 16, 1986, by the present inventors, which application is hereby incorporated herein by reference.

In still further accordance with the present invention, means are provided for adapting the ventilator to the size of the installation opening. As embodied herein and shown for example in FIGS. 5–9, the adapting means preferably comprises a cylindrical threaded member such as a bolt, indicated generally as 50, having at one end means for receiving an adjustment tool. As embodied herein, the means for receiving an adjustment tool preferably comprises a slotted portion 52 configured to receive an adjustment tool such as the blade of a screwdriver (not shown).

Figure 5:
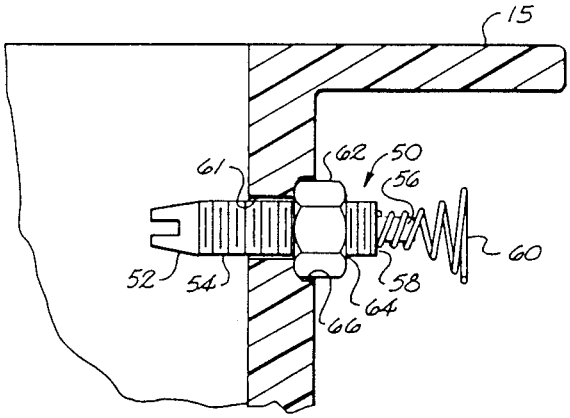
FIG. 5 is a side view partially in cross-section, of a portion of a ventilator structure according to the teachings of the present invention.
Figure 6:
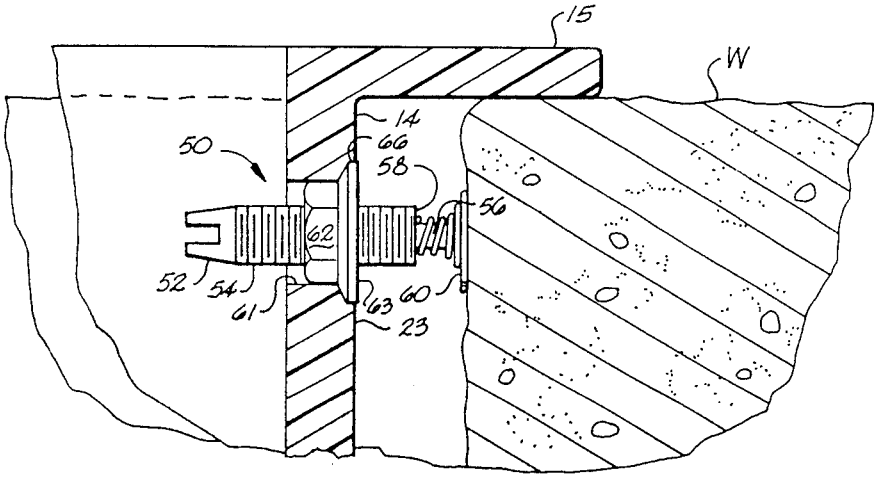
FIG. 6 is a view, partially in cross-section, taken along lines 6—6 of FIG. 1.
Figure 7:
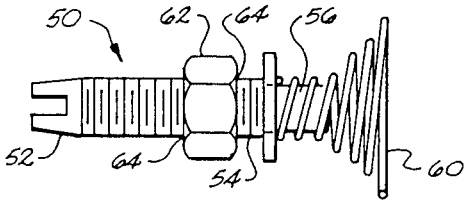
FIG. 7 is a side perspective view of a component of an embodiment of the present invention.
Figure 8:
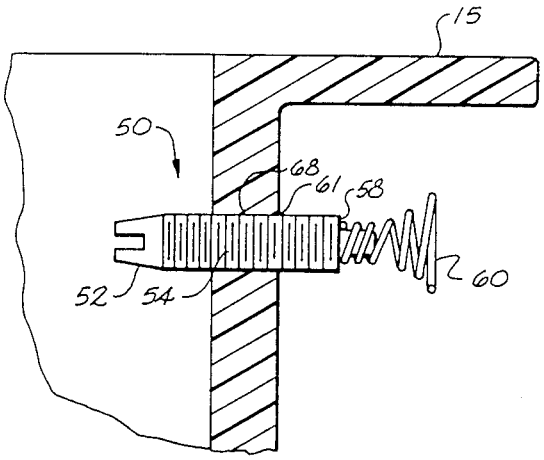
FIG. 8 is a side view, partially in cross-section, of a portion of an embodiment of the ventilator of the present invention.

Bolt 50 has an intermediate externally threaded portion 54 and a distal portion 56 at the end opposite the end having the means for receiving an adjustment tool. The distal portion has a diameter smaller than the diameter of the intermediate threaded portion and is preferably integral therewith and concentric thereto. As best shown in FIGS. 5, 6, and 8, a ridge 58 is formed by the free end of the intermediate threaded portion which does not contact the distal portion. The cross-sectional diameter of the distal portion preferably is uniform and the surface of the distal portion is preferably smooth rather than threaded.

The adapting means further preferably comprises a compression spring 60 which preferably is conically shaped. The free length of the compression spring is preferably in the range of 0.478 inches to 0.493 inches. The length of the compression spring preferably is about twice the length of the distal portion and comprises about four and one-half coils with the coils at both ends being closed. One end of the compression spring has a diameter configured to permit this end to fit securely around the distal portion of the bolt. The end of compression spring 60 configured to fit around distal portion 56 of bolt 50 is preferably the smaller diameter end of spring 60. As shown in FIG. 6 for example, the larger diameter end of spring 60 is preferably configured to contact a surface of wall W that faces the exterior of a side wall 22, 23, 24, or 25 of housing 20. Compression spring 60 preferably is formed of spring steel wire No. 41, which is sometimes referred to as 0.041 h.p. wire. The larger diameter end of compression spring 60 preferably has an outside diameter of approximately 0.3781 inches. The smaller diameter end of compression spring 60 preferably has an outside diameter of approximately 0.187 inches. The smaller diameter end of compression spring 60 butts against ridge 58 and fits securely on distal portion 56. Rotation of distal portion 56 also causes rotation of compression spring 60 so that compression spring 60 is fitted non-rotatably relative to distal portion 56. For this reason, the fit of compression spring 60 around distal portion 56 is a friction fit, and accordingly, rotation of compression spring 60 relative to distal portion 56 will occur once the coefficient of friction is overcome. However, compression spring 60 is preferably left-hand-wound so that if it should rotate on distal portion 56, spring 60 will tend not to screw itself around threaded portion 54 of bolt 50.

A preferred embodiment of the adapting means further includes an internally threaded member. As shown for example in FIGS. 5–7, the internally threaded member preferably comprises a nut 62 which has a threaded aperture 64 configured to engage threaded portion 54 of bolt 50. As shown for example in FIGS. 5 and 6, a recess 66 is defined in the outside portion of one of housing side walls 22, 23, 24, and 25 and is generally concentric to and surrounding an opening 61 defined through the side wall. In the FIG. 5 embodiment, recess 66 is configured to non-rotatably engage the exterior surface of nut 62. In one typical embodiment such as shown in FIG. 5 for example, the cross-sectional perimeter of recess 66 is a polygon matching the cross-sectional perimeter of nut 62.

In a preferred embodiment shown in FIG. 6 for example, nut 62 has a flanged head 63 which is received within recess 66 so that the exposed surface of head 63 is flush with the housing side wall.

The adapting means of the present invention includes at least one opening 61 defined through any one of side walls 22, 23, 24, and 25 through which it is desired to insert bolt 50. In the preferred embodiment of the adapting means shown in FIG. 6, in which the internally threaded member comprises nut 62 with flanged head 63, opening 61 is formed through the desired side wall, and is configured to non-rotatably hold nut 62 to permit passage of bolt 50 therethrough so that bolt 50 freely rotates within nut 62. As shown in FIGS. 3 and 6, opening 61 is hexagonally shaped to non-rotatably engage hex-shaped nut 62. When nut 62 is non-rotatably engaged by opening 61 of the housing side wall, rotation of bolt 50 causes longitudinal displacement of bolt 50 relative to the housing side wall and relative to nut 62. Bolt 50 is extended into and through opening 64 in nut 62 so that slotted portion 52 of bolt 50 extends inside the interior of the side wall defining opening 61, and distal portion 56 of bolt 50 extends outside of housing 20.

Figure 9:
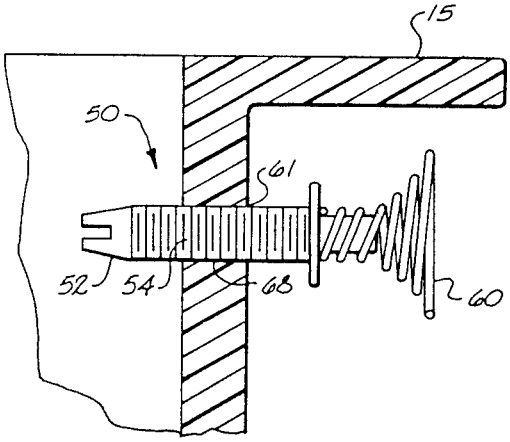
FIG. 9 is a side view, partially in cross-section, of a portion of another embodiment of the ventilator of the present invention.

In another alternative embodiment, shown for example in FIGS. 8 and 9, opening 61 of the one housing side wall is generally cylindrical and has a surface 68 which is threaded to engage the external threads of threaded portion 54 of bolt 50. In such embodiments, opening 61 has a diameter sized so that the threads of bolt 50 engage the threads of opening surface 68. Rotation of bolt 50 within the interior threaded portion of side wall opening 61 causes longitudinal displacement of bolt 50 relative to the side wall.

The number of openings 61 through one of the side walls of housing 20 can be greater than one, but generally a single bolt 50 and opening 61, such as shown for example in FIG. 1, will suffice for the adapting means of the present invention. However, in some embodiments such a shown in FIGS. 1 and 3, more than one combination bolt 50 and opening 61 will be desirable. Accordingly, it is contemplated that a plurality of bolts 50 and corresponding openings 61 can be provided in one of the side walls of housing 20. However, when more than one combination bolt 50, spring 60 and opening 61 are provided, all such combinations preferably are provided on only one side wall of the housing. In a preferred embodiment, the adapting means comprises a pair of bolts 50 spaced apart through only one side wall of housing 20, such as shown for example in FIG. 1. As shown in the Figs., the adapting means is preferably provided in one of the side walls which extends in a direction parallel to the direction of the force of gravity, rather than transverse to same.

The provision of the adapting means on only one side wall of the housing renders the ventilator less likely to rotate, even in embodiments in which only one bolt is inserted through the center of the side wall such as shown in FIG. 2. This is because the side wall opposite the one with the adapting means, rests flush against the interior of the foundation wall opening and fails to provide an axis about which the ventilator is likely to pivot. Moreover, the preferred embodiment of the ventilator of the present invention, which includes the preferred embodiment of the adapting means comprising two bolts spaced apart near the corners of only one side wall, provides further stability and renders pivoting even less likely because of the second independent contact with the interior of the opening in wall W.

In addition, the retractable feature of bolt 50 renders it easier to adapt the ventilator to foundation openings that might initially be too small. This is because not only does the coil spring compress, but the base of this coil spring attached to the screw can be moved longitudinally toward the side wall of the housing or away from same as required to control adjustment of the opening size.

In a further alternative embodiment of the adapting means of the present invention, there is provided a retaining means. As embodied herein and shown for example in FIGS. 7 and 9, the retaining means preferably comprises a spring collar such as washer 70 having a non-threaded central opening therethrough. The diameter of the central opening of the washer is large enough to permit passage of distal portion 56 therethrough, but small enough to preclude passage of threaded portion 54 therethrough. In this alternative embodiment, washer 70 is placed around distal portion 56 and moved therealong until one flat surface of washer 70 butts against ridge 58. Then the smaller end of compression spring 60 receives the protruding end of distal portion 56 therethrough until the compression spring 60 butts against the opposite surface of washer 70. Washer 70 can be formed integrally as part of bolt 50 or formed as a separate structure.

It often occurs that the installation openings prepared in walls W for the ventilators have been improperly sized and will not provide a secure fit of the ventilator when it is positioned within the installation opening. The installer can determine where the ventilator dimension needs to be extended and accordingly slip in, or screw in, one of the devices comprising the installation size adapting means of the present invention. The end of bolt 50 defining slotted portion 52 is positioned so that it is exposed from the sides of housing side walls 22, 23, 24, and 25 that face the air passageway. Thus, bolt 50 is disposed so that slotted portion 52 generally faces the air passageway and is accessible therefrom by means of the adjustment tool. Bolts 50 preferably are disposed to extend through a housing side wall between flange 15 and openwork grid structure 21. Once this has been done, the ventilator is returned to the improperly sized installation opening for adjustment with a screwdriver engaging slotted portion 52 of bolt 50 from the interior facing surface of side walls 22, 23, 24, and 25. As shown for example in FIG. 6, longitudinal displacement of bolt 50 by rotation of same eventually causes the larger diameter end of conical compression spring 60 to contact the surface of the wall defining the installation opening to secure the ventilator within the opening.

The provision of longitudinal adjustment of bolt 50 relative to the housing side wall by the slotted portion of bolt 50 facing the interior of the housing and the threaded intermediate portion of bolt 50 engaging either nut 62 or threaded surface 68 in the housing side wall, renders the adapting means controllably adjustable. This is because the adjustment is under the direct control of the operator of the adjustment tool. The continuous adjustment provided by the engagement between threaded intermediate portion 54 and either nut 62 or threaded surface 68 of opening 61, renders the adapting means infinitely controllably adjustable. The provision of the compression spring renders the adapting means self-adjusting.

Having described the present invention in detail, it is obvious that one skilled in the art will be able to make variations and modifications thereto without departing from the scope of the invention. Accordingly, the scope of the present invention should be determined only by the claims appended hereto.

What is claimed is:

1. An automatic ventilator to be received in an installation opening, the ventilator comprising:

(a) a housing, said housing having peripheral side walls defining an air passageway therethrough;

(b) at least one shutter element received in said air passageway and mounted to said housing for rotary movement between a closed position where the passageway is generally closed and an open position where the passageway is generally open to the passage of ventilating air therethrough;

(c) temperature responsive drive means operatively associated with said shutter element for driving said shutter element between said open and closed positions;

(d) means for adapting the ventilator to the size of the installation opening, said adapting means being self-adjusting, continuously controllably adjustable, and connected to only one of said side walls and including a compression spring;

(e) whereby temperature variation effects on said drive means cause said shutter element to move toward an open or closed position;

(f) said adapting means comprising a cylindrical threaded member having an externally threaded portion and a non-threaded distal portion of uniform cross-sectional diameter smaller than the diameter of said threaded portion, said non-threaded distal portion for receiving said compression spring.

2. An automatic ventilator as defined in claim 1, wherein said cylindrical threaded member has means for receiving an adjustment tool at one end of said threaded member.

3. An automatic ventilator as defined in claim 2, wherein said adapting means comprises an internally threaded member non-rotatably secured to said housing of said ventilator and having a threaded cylindrical aperture configured to engage said threaded portion of said threaded member.

4. An automatic ventilator as defined in claim 2, wherein said distal portion is integral with said threaded member at one end thereof opposite the end having said means for receiving an adjustment tool, said compression spring having one end with a diameter larger than the diameter at the other end and having an intermediate portion gradually increasing in diameter from said smaller end to said larger end.

5. An automatic ventilator to be received in an installation opening, the ventilator comprising:

(a) a housing, said housing having peripheral side walls defining an air passageway therethrough;

(b) at least one shutter element received in said air passageway and mounted to said housing for rotary movement between a closed position where the passageway is generally closed and an open position where the passageway is generally open to the passage of ventilating air therethrough;

(c) temperature responsive drive means operatively associated with said shutter element for driving said shutter element between said open and closed positions;

(d) means for adapting the ventilator to the size of the installation opening, said adapting means being self-adjusting, continuously controllably adjustable, and connected to only one of said side walls;

(e) whereby temperature variation effects on said drive means cause said shutter element to move toward an open or closed position;

(f) said adapting means further comprising a cylindrical threaded member having means for receiving an adjustment tool at one end of said member and having an externally threaded portion;

(g) said adapting means further comprising an internally threaded member non-rotatably secured to said housing of said ventilator and having a threaded cylindrical aperture configured to engage said threaded portion of said threaded member;

(h) said adapting means further comprising a non-threaded distal portion of uniform cross-sectional diameter smaller than the diameter of said threaded member;

(i) said distal portion being integral with said threaded member at one end thereof opposite the end having said means for receiving an adjustment tool;

(j) said adapting means including a compression spring, said spring having one end with a diameter larger than the diameter at the other end and having an intermediate portion gradually increasing in diameter from said smaller end to said larger end; and (k) said smaller end of said compression spring being friction fitted around said distal portion. housing of said ventilator and having a threaded cylindrical aperture configured to engage said threaded portion of said threaded member.

6. An automatic ventilator as defined in claim 5, wherein:

said means for receiving an adjustment tool includes a slotted portion disposed to face toward said air passageway and accessible from said air passageway by the adjustment tool and wherein said adapting means includes a spring collar, said spring collar having a diameter larger than the diameter of said smaller end of said compression spring, said spring collar having an aperture with a diameter substantially equal to the diameter of said distal portion and smaller than the diameter of said threaded member, said aperture of spring collar fitting rotatably around said distal portion, said spring collar having one flat surface resting against a free end of said threaded member and having an opposite flat surface for contacting the end of said compression spring having said smaller diameter.

7. An automatic ventilator as defined in claim 6, wherein said adapting means is adjustable relative to said ventilator housing by rotating said threaded member within said threaded aperture of said internally threaded member.

8. An automatic ventilator as defined in claim 7, wherein a plurality of interconnected shutter elements are provided, one of said shutter elements only being directly connected to said drive means.

9. An automatic ventilator as defined in claim 8, wherein said shutter elements are interconnected by an elongated element secured to an end of each shutter element.

10. An automatic ventilator as defined in claim 9, wherein said drive means is a bimetallic coil spring.

11. An automatic ventilator as defined in claim 10, further comprising a front collar being formed integrally with said housing side walls and defining a peripheral flange therearound and extending outwardly from said side walls.

12. An automatic ventilator as defined in claim 11, wherein said housing further comprises an openwork grid structure secured to said side walls and extending across said passageway and wherein said threaded aperture is defined in said side wall between said flange and said openwork grid structure and said slotted portion of said adapting means is accessible from in front of said openwork grid structure.

13. An automatic ventilator as defined in claim 10, further comprising a collar element secured to said housing around one end thereof, said collar element having a peripheral flange therearound extending outwardly from said housing, said threaded aperture being defined in said side wall between said flange and said openwork grid structure and said slotted portion of said adapting means being accessible from in front of said openwork grid structure.

14. An automatic ventilator to be received in an installation opening, the ventilator comprising:

(a) a housing, said housing having peripheral side walls defining an air passageway therethrough;

(b) at least one shutter element received in said air passageway and mounted to said housing for rotary movement between a closed position where the passageway is generally closed and an open position where the passageway is generally open to the passage of ventilating air therethrough;

(c) temperature responsive drive means operatively associated with said shutter element for driving said shutter element between said open and closed positions;

(d) means for adapting the ventilator to the size of the installation opening, said adapting means being continuously controllably adjustable and self-adjusting and connected to only one of said side walls, and wherein said adapting means includes:

(i) a cylindrical threaded member having means for receiving an adjustment tool at one end and having an externally threaded portion, (ii) a non-threaded distal portion concentric and integral with one end of said threaded member and having a uniform cross-sectional diameter smaller than the diameter of said threaded member, (iii) a conically shaped compression spring having a smaller diameter portion friction fitted around said distal portion, the length of said compression spring being approximately twice the length of said distal portion when said spring is uncompressed, and (iv) a cylindrical threaded opening defined in said housing and configured to engage said externally threaded portion of said threaded member;

(e) wherein said threaded portion of said threaded member rotatably engages said threaded opening in said housing; and (f) whereby temperature variation effects on said drive means cause said shutter element to move toward an open or closed position.

15. An automatic ventilator as defined in claim 14, wherein a plurality of interconnected shutter elements are provided, one of said shutter elements only being directly connected to said drive means.

16. An automatic ventilator to be received in an installation opening, the ventilator comprising:

(a) a housing, said housing having peripheral side walls defining an air passageway therethrough;

(b) at least one shutter element received in said air passageway and mounted to said housing for rotary movement between a closed position where the passageway is generally closed and an open position where the passageway is generally open to the passage of ventilating air therethrough;

(c) temperature responsive drive means operatively associated with said shutter element for driving said shutter element between said open and closed positions;

(d) means for adapting the ventilator to the size of the installation opening, said adapting means being connected to only one of said side walls and continuously controllably adjustable and self-adjusting, and wherein said adapting means includes:

(i) a cylindrical threaded member having means for receiving an adjustment tool at one end and having an externally threaded portion, (ii) a non-threaded distal portion concentric and integral with one end of said threaded member and having a uniform cross-sectional diameter smaller than the diameter of said threaded member, (iii) a left-hand-wound compression spring friction fitted around said distal portion, (iv) an internally threaded member having an aperture therethrough with threads on the surface of said aperture configured to engage said externally threaded portion of said cylindrical threaded member, (v) said internally threaded member having a flange portion at one end thereof, (vi) an opening defined in said housing and configured to non-rotatably engage an exterior surface of said internally threaded member, (vii) a recess defined in said housing surrounding and concentric with said opening defined in said housing, said recess being open to the exterior of said housing and configured to receive said flange of said internally threaded member; and (e) whereby temperature variation effects on said drive means cause said shutter element to move toward an open or closed position.

17. An automatic ventilator to be received in an installation opening, the ventilator comprising:

(a) a housing, said housing having peripheral side walls defining an air passageway therethrough;

(b) at least one shutter element received in said air passageway and mounted to said housing for rotary movement between a closed position where the passageway is generally closed and an open position where the passageway is generally open to the passage of ventilating air therethrough;

(c) temperature reponsive drive means operatively associated with said shutter element for driving said shutter element between said open and closed positions;

(d) means for adapting the ventilator to the size of the installation opening, said adapting means being self-adjusting, continuously controllably adjustable, and connected to only one of said side walls;

(e) whereby temperature variation effects on said drive means cause said shutter element to move toward an open or closed position;

(f) said adapting means comprising a cylindrical threaded member having means for receiving an adjustment tool at one end of said member and having an externally threaded portion;

(g) said adapting means further comprising an internally threaded member non-rotatably secured to said housing of said ventilator and having a threaded cylindrical aperture configured to engage said threaded portion of said threaded member;

(h) said adapting means further comprising a non-threaded distal portion of uniform cross-sectional diameter smaller than the diameter of said threaded member;

(i) said distal portion being integral with said threaded member at one end thereof opposite the end having said means for receiving an adjustment tool;

(j) said adapting means including a compression spring; and (k) one end of said compression spring being friction fitted around said distal portion.

* * * * *